US009305510B2

(12) United States Patent
Chen

(10) Patent No.: US 9,305,510 B2
(45) Date of Patent: Apr. 5, 2016

(54) LCD DRIVING MODULE, LCD DEVICE, AND METHOD FOR DRIVING LCD

(75) Inventor: Yinhung Chen, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 736 days.

(21) Appl. No.: 13/515,278

(22) PCT Filed: Apr. 27, 2012

(86) PCT No.: PCT/CN2012/074799

§ 371 (c)(1),
(2), (4) Date: Jun. 11, 2012

(87) PCT Pub. No.: WO2013/159320

PCT Pub. Date: Oct. 31, 2013

(65) Prior Publication Data

US 2013/0286056 A1 Oct. 31, 2013

(30) Foreign Application Priority Data

Apr. 26, 2012 (CN) ..... 2012 1 0125059

(51) Int. Cl.
*G09G 5/10* (2006.01)
*G09G 3/36* (2006.01)

(52) U.S. Cl.
CPC ..... *G09G 3/3685* (2013.01); *G09G 3/3696* (2013.01); *G09G 2320/0673* (2013.01); *G09G 2370/08* (2013.01); *G09G 2370/14* (2013.01)

(58) Field of Classification Search
None
See application file for complete search history.

(56) References Cited

U.S. PATENT DOCUMENTS

| | | | | |
|---|---|---|---|---|
| 2006/0232579 | A1* | 10/2006 | Chen et al. | 345/211 |
| 2006/0284897 | A1* | 12/2006 | Shen et al. | 345/690 |
| 2008/0001897 | A1* | 1/2008 | Lim | 345/98 |
| 2008/0136806 | A1* | 6/2008 | Lee et al. | 345/212 |
| 2008/0239158 | A1* | 10/2008 | Wu et al. | 348/677 |
| 2010/0134470 | A1* | 6/2010 | Bu et al. | 345/212 |
| 2010/0259564 | A1* | 10/2010 | Ahn et al. | 345/690 |

FOREIGN PATENT DOCUMENTS

| | | | |
|---|---|---|---|
| CN | 1523564 | A | 8/2004 |
| CN | 1713037 | A | 12/2005 |
| CN | 101097704 | A | 1/2008 |

(Continued)

OTHER PUBLICATIONS

Wei Yanyan, the first office action, Apr. 2013, CN.

(Continued)

*Primary Examiner* — Joseph Feild
*Assistant Examiner* — Henok Heyi
(74) *Attorney, Agent, or Firm* — IPro, PLLC; Na Xu

(57) ABSTRACT

The invention discloses an LCD driving module, an LCD device, and a method for driving an LCD. The LCD driving module includes a data driving module and a timing control circuit. The data driving module is provided with a data interface via which to connect with the timing control circuit; a programmable Gamma calibration sub-module is integrated in the data driving module; an input end of the programmable Gamma calibration sub-module is connected to the data interface. The invention saves the PCB space, simplifies the circuit, thereby favoring the acceleration of the development progress and saving the development cost.

1 Claim, 3 Drawing Sheets

(56) References Cited

FOREIGN PATENT DOCUMENTS

| | | | |
|---|---|---|---|
| CN | 101145322 | A | 3/2008 |
| CN | 101458907 | A | 6/2009 |
| CN | 101727850 | A | 6/2010 |
| CN | 101751842 | A | 6/2010 |
| JP | 2010096893 | A | 4/2010 |

OTHER PUBLICATIONS

Chang Qing, the International Searching Authority written comments, Feb. 2013, CN.

* cited by examiner

LCD DRIVING MODULE, LCD DEVICE, AND METHOD FOR DRIVING LCD

TECHNICAL FIELD

The invention relates to the field of electronic displays, and more particularly to a liquid crystal display (LCD) driving module, an LCD device, and a method for driving an LCD.

BACKGROUND

In a structure for driving an LCD, there are two methods for setting a Gamma voltage output value. One method is to externally hang a programmable Gamma calibration chip (P-Gamma IC) to set a Gamma voltage output value by a digital mode, and the other method is that a resistor string is used and a voltage which is output by an external multi-channel operational amplifier (OP) or internal independent OP(s) of a source driver is used as a Gamma voltage. The first method increases the occupied area of the P-Gamma IC on the C/B PCB, and the second method cannot directly and quickly change the Gamma voltage, which needs to select rework resistance values.

SUMMARY

In view of the above-described problems, the aim of the invention is to provide an LCD driving module, an LCD device, and a method for driving an LCD capable of reducing the occupied area of PCB and directly and rapidly changing Gamma voltages.

The aim of the invention is achieved by the following technical schemes.

An LCD driving module comprises a data driving module and a timing control circuit. The data driving module is provided with a data interface via which to connect with the timing control circuit, a programmable Gamma calibration sub-module is integrated in the data driving module, and an input end of the programmable Gamma calibration sub-module is connected to the data interface.

Preferably, the data driving module is internally provided with an independent first OP. In addition, the programmable Gamma calibration sub-module is internally provided with a second OP. An output signal of the programmable Gamma calibration sub-module is connected to the first or the second OP. Each OP outputs a Gamma voltage value. Each OP of an original data driving module is provided with an input pin and an output pin; thus, one OP employs two pins. After the programmable Gamma calibration sub-module is integrated in the data driving module, the input of the original OP is connected to the programmable Gamma calibration sub-module. Each original OP can make full use of pin resources, thereby reducing circuit redundancy and favoring the reduction of material cost.

Preferably, the data driving module is internally provided with two independent first OPs; the programmable Gamma calibration sub-module is internally provided with two second OPs. This is a specific circuit structure.

Preferably, there is a plurality of data driving modules, and the programmable Gamma calibration sub-module is integrated in each of the data driving module. Because the number of the Gamma voltage output circuits of a single data driving module is limited, the number of the Gamma voltage output circuits is added by providing a plurality of data driving modules.

An LCD device comprises the LCD driving module mentioned above.

A method for driving an LCD comprises the following steps:

A: transmitting original data comprising a Gamma voltage to a data driving module integrated with a programmable Gamma calibration sub-module via a uniform data interface by a timing control circuit;

B: sorting out display data and Gamma voltage data from the original data by the data driving module, and transmitting the Gamma voltage data to the programmable Gamma calibration sub-module integrated inside the data driving module; and C: outputting a display signal and the Gamma voltage by the data driving module.

Preferably, in step A, when the LCD is started, the timing control circuit first transmits the Gamma voltage data to the data driving module via the uniform data interface. Generally, a transitory blank screen is required when a new Gamma voltage value is written; when the LCD is started, the LCD itself has a process of gradual brightening from the blank screen. The Gamma voltage data are written during this process and thus the influence on normal viewing is minimal.

Preferably, the original data comprises a reset bit and a data bit, and a sign bit is arranged between the reset bit and the data bit. In step B, the data driving module sorts out the display data and the Gamma voltage data by reading a level signal in the sign bit. This is a specific original data format. Because the sign bit is arranged, the data driving module can determine that the coming data bit is the display data or the Gamma voltage data by distinguishing the high and low level states of the sign bit. The technical scheme is simple and highly practicable.

Preferably, in step C, the programmable Gamma calibration sub-module outputs the Gamma voltage via its own OP(s) and independent OP(s) inside the data driving module, which increases the number of the Gamma voltages simultaneously outputted, and makes full use of resources of the conventional circuit, thereby reducing circuit redundancy and favoring the reduction of material cost.

Preferably, when the Gamma voltage data are required to be changed in the process of displaying, step C comprises that: when the Gamma voltage is changed, the data driving module outputs a black signal in the currently displayed frame and resumes normal display in the next frame. The data driving module outputs the black signal in the currently displayed frame, which can avoid the problems of numerical write error, etc., due to too many programmable Gamma calibration sub-module values.

In the invention, because the PGamma correction function is integrated in the data driving module, no Gamma correcting circuit is added in a PCB, and the PCB space is saved, the circuit is simplified, thereby accelerating development progress and saving development cost. In addition, the input of the programmable Gamma calibration sub-module shares the data interface of the data driving module, and the data input is also controlled by the timing control circuit without the need of an additional line. The data input can be dynamically regulated and changed at any time without effect on feeling of human eyes. The shared data interface can also reduce the number of data transmission pins, and further simplify the circuit.

DETAILED DESCRIPTION

The invention will further be described in detail in accordance with the figures and the preferable examples.

An LCD device comprises an LCD panel. The LCD panel comprises scan lines and data lines which are crossed, and an LCD driving module used for driving the scan lines and the data lines.

Figure 1:
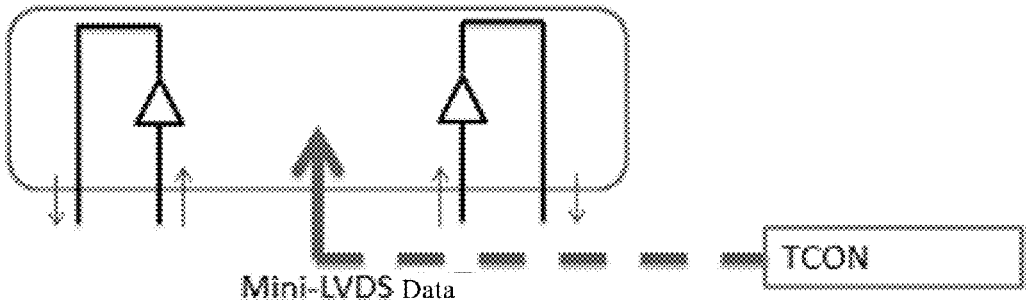
FIG. 1 is a schematic diagram of a conventional data driving module.
Figure 2:
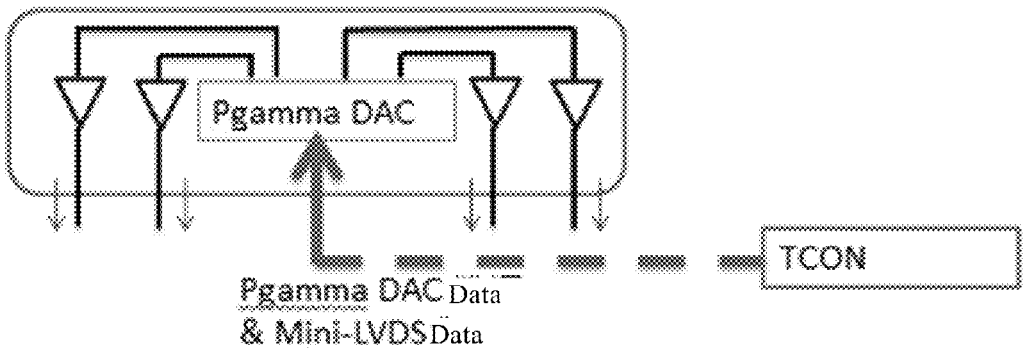
FIG. 2 is a schematic diagram of an LCD driving module of the invention.

As shown in FIG. 2, the LCD driving module comprises a data driving module and a timing control circuit. The data driving module is provided with a data interface via which to connect with the timing control circuit. A programmable Gamma calibration sub-module is integrated in the data driving module; an input end of the programmable Gamma calibration sub-module is connected to the data interface. A low voltage differential signal interface (mini-LVDS) is used as the data interface so as to reduce data transmission errors.

The data driving module is internally provided with an independent first OP(s). In addition, the programmable Gamma calibration sub-module is internally provided with a second OP(s). An output signal of the programmable Gamma calibration sub-module is connected to the first OP(s) or the second OP(s). Each OP outputs a Gamma voltage value.

Figure 3:
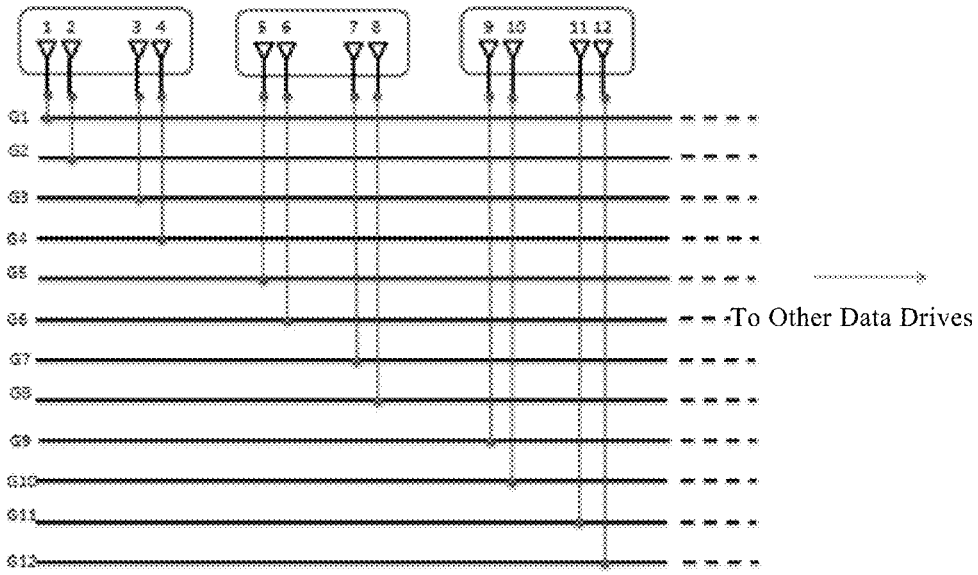
FIG. 3 is a schematic diagram of the invention applied to an LCD device.

When the programmable Gamma calibration sub-module (PGamma DAC) is used and the timing control circuit (TCON) commands via the low voltage differential signal interface (mini-LVDS), one input pin is saved, and the saved pin can be used as another OP output. For example, a common data driving module (source driver) comprises two internal OPs, no input pin is needed when the programmable Gamma calibration sub-module (PGamma DAC) is arranged, so there are two redundant pins which can be used for other two added OPs output, and there are four OPs in total (as shown in FIG. 2). Because each data driving module (source driver) of the invention has four OPs which can output four groups of Gamma voltages, if twelve groups of Gamma voltages are needed, three data driving modules (source driver) are enough (as shown in FIG. 3).

In the invention, the programmable Gamma calibration sub-module (PGamma DAC) is integrated in the data driving module (source driver), the internal independent OP in the data driving module (source driver) is directly used, and the timing control circuit (TCON) sends command, it is easy to change the Gamma voltage at any time. On the other hand, the OP in the data driving module (source driver) has an input and an output; one OP comprises two pins. When the programmable Gamma calibration sub-module is used instead, the timing control circuit (TCON) sends command via the data pair of the low voltage differential signal interface (mini-LVDS); one input pin is saved, and the saved pin can be used as another OP output.

In the invention, the programmable Gamma calibration sub-module is integrated in the data driving module (source driver). Thus, the programmable Gamma calibration (PGamma) IC on C/B is saved, the circuit is reduced, and the PCB space is saved. If C and X are designed to be separated, the pin number of a flexible flat cable (FFC connector) can be reduced. The PGamma voltage output value can be changed at any time when the timing control circuit (TCON) sends command via the original mini-LVDS interface. No additional line is needed, and the PGamma voltage output value can be dynamically regulated and changed at any time without effect on feeling of human eyes. If one data driving module (COF) only has four pins connected with OP, in this design, original two OPs become four OPs without the need of adding pins.

A method for driving an LCD mentioned above comprises the following steps:

A: transmitting original data comprising a Gamma voltage to a data driving module integrated with a programmable Gamma calibration sub-module via a uniform data interface by a timing control circuit.

Preferably, when starting an LCD, the timing control circuit first transmits the Gamma voltage data to the data driving module via the uniform data interface. Generally, a transitory blank screen is required when a new Gamma voltage value is written; when the LCD is started, the LCD itself has a process of gradual brightening from the blank screen. The Gamma voltage data are written during this process and thus the influence on normal viewing is minimal.

B: sorting out display data and Gamma voltage data from the original data by the data driving module, and transmitting the Gamma voltage data to the programmable Gamma calibration sub-module integrated inside the data driving module.

Figure 4:
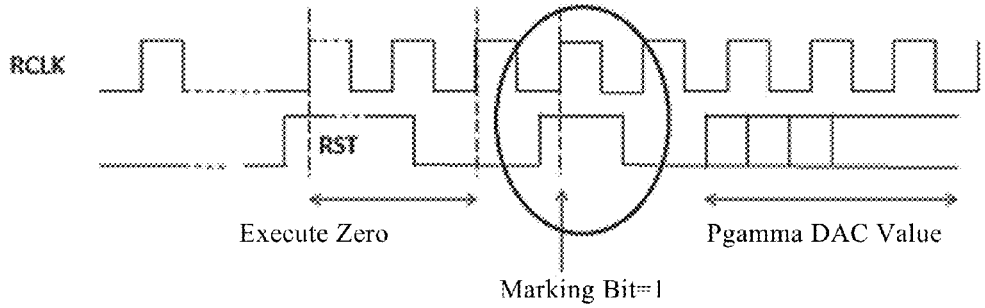
FIG. 4 is a schematic diagram of waveform when a sign bit of original data is a high level in an LCD driving method of the invention.
Figure 5:
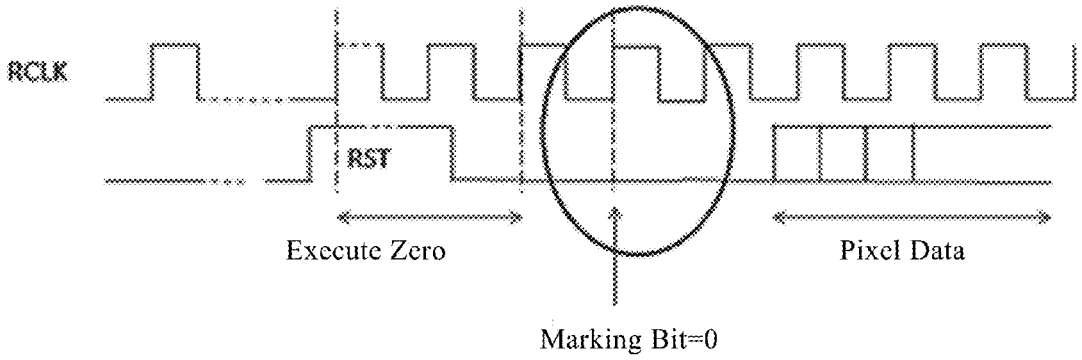
FIG. 5 is a schematic diagram of waveform when a sign bit of original data is a low level in an LCD driving method of the invention.

As shown in FIG. 4 and FIG. 5, the original data comprises a reset bit and a data bit; a sign bit is arranged between the reset bit and the data bit. The data driving module sorts out the display data and the Gamma voltage data by reading a level signal of the sign bit. Because the sign bit is added, the data driving module can determine the coming data bit is the display data or the Gamma voltage data by distinguishing the high and low level states of the sign bit. For example, when the sign bit is "0", the coming data bit is a programmable Gamma calibration sub-module value; when the sign bit is "1", the coming data bit is the display data.

C: outputting a display signal and the Gamma voltage by the data driving module.

The programmable Gamma calibration sub-module outputs the Gamma voltage via its own OP(s) and independent OP(s) inside the data driving module, which increases the number of the Gamma voltages simultaneously outputted, and makes full use of resources of the conventional circuit, thereby reducing circuit redundancy and favoring the reduction of material cost.

When the Gamma voltage data are required to be changed in a liquid crystal display process, the data driving module outputs a black signal in the currently displayed frame and resumes normal display in the next frame. The data driving module outputs the black signal in the currently displayed frame, which can avoid the problems of numerical write error, etc., due to too many programmable Gamma calibration sub-module values.

In the invention, the original mini-LVDS interface transmits the programmable Gamma calibration sub-module (PGamma DAC) values via the timing control circuit (TCON). In addition, a bit is added behind the reset bit (RST) as the sign bit so that the data driving module (source driver) determines the data received currently is the programmable Gamma calibration sub-module values or the pixel data. For example, when the bit is 1, the data driving module (source driver) will receive the programmable Gamma calibration sub-module value from the timing control circuit (TCON); to prevent too many programmable Gamma calibration sub-module values, the LCD driving module (data driver) requires to automatically output a black picture (gray 0 picture) in this frame, as shown in FIG. 4. In the next frame, the LCD driving module outputs a normal picture, as shown in FIG. 5. The time point of writing the programmable Gamma calibration sub-module (PGamma DAC) is the starting time or is in process of the normal display. The black picture of one frame is only displayed in the process of changing the Gamma voltage, and the effect on human eyes is very small.

The invention is described in detail in accordance with the above contents with the specific preferred examples. However, this invention is not limited to the specific examples. For the ordinary technical personnel of the technical field of the invention, on the premise of keeping the conception of the invention, the technical personnel can also make simple deductions or replacements, and all of which should be considered to belong to the protection scope of the invention.

I claim:

1. A method for driving an LCD driving module, comprising:

A: transmitting original data comprising a Gamma voltage to a data driving module integrated with a programmable Gamma calibration sub-module via a uniform data interface by a timing control circuit;

B: sorting out display data and Gamma voltage data from the original data by the data driving module, and transmitting the Gamma voltage data to the programmable Gamma calibration sub-module integrated inside the data driving module; and C: outputting a display signal and the Gamma voltage by the data driving module, wherein in step A, when the LCD is started, the timing control circuit first transmits the Gamma voltage data to the data driving module via the uniform data interface, wherein said original data comprises a reset bit and a data bit; a sign bit is arranged between said reset bit and said data bit; in step B, the data driving module sorts out the display data and the Gamma voltage data by reading a level signal of the sign bit.

* * * * *